US005765970A

United States Patent [19]

Fox

[11] Patent Number: 5,765,970

[45] Date of Patent: Jun. 16, 1998

[54] PLASTIC RETAINING WALL CONSTRUCTION

[76] Inventor: James C. Fox, 4431 Rexford, Holt, Mich. 48842

[21] Appl. No.: 664,842

[22] Filed: Jun. 17, 1996

[51] Int. Cl.[6] ..... E04B 2/08

[52] U.S. Cl. ..... 405/284; 52/592.6; 52/604; 52/606

[58] Field of Search ..... 405/284, 285, 405/286; 52/146, 561, 589.1, 592.6, 604, 606

[56] References Cited

U.S. PATENT DOCUMENTS

| | | | |
|---|---|---|---|
| 831,714 | 9/1906 | Follett | 52/146 |
| 876,248 | 1/1908 | Tiedeman | 52/146 |
| 1,203,934 | 11/1916 | Straight | 52/606 |
| 2,313,363 | 3/1943 | Schmitt | 405/286 |
| 3,236,054 | 2/1966 | Northrup | 52/146 |
| 3,416,276 | 12/1968 | Caputo et al. | 52/606 |
| 3,668,832 | 6/1972 | Harman . | |
| 4,193,718 | 3/1980 | Wahrendorf et al. | 405/286 |
| 4,229,123 | 10/1980 | Heinzmann | 405/273 |
| 4,596,103 | 6/1986 | Couwenbergs | 52/604 |
| 4,619,560 | 10/1986 | Crinnion et al. | 405/284 |
| 4,653,962 | 3/1987 | McKittrick et al. | 405/286 |
| 4,711,606 | 12/1987 | Leling et al. | 405/286 |
| 4,832,528 | 5/1989 | Lisart | 405/116 |
| 4,917,543 | 4/1990 | Cole et al. | 405/262 |
| 5,017,049 | 5/1991 | Sievert | 405/284 |
| 5,086,599 | 2/1992 | Meyerson | 52/309.9 |
| 5,178,492 | 1/1993 | Meheen | 405/284 |
| 5,221,702 | 6/1993 | Richards . | |
| 5,224,801 | 7/1993 | Quaney . | |
| 5,261,205 | 11/1993 | Sandor . | |
| 5,370,480 | 12/1994 | Quaney . | |
| 5,425,600 | 6/1995 | Gordon | 405/284 |
| 5,435,669 | 7/1995 | Weber | 405/284 |
| 5,542,787 | 8/1996 | Charlanow . | |
| 5,567,089 | 10/1996 | Akamine | 405/285 |
| 5,607,262 | 3/1997 | Martin | 405/284 |

*Primary Examiner*—Tamara L. Graysay
*Assistant Examiner*—Gary S. Hartmann
*Attorney, Agent, or Firm*—John R. Benefiel

[57] ABSTRACT

A retaining wall construction using courses of lightweight hollow timbers molded from plastic and having interfit portions and the adjacent bottom and top edges which seal the spaces between the courses. Vertical whaler posts connected to the rear face of the timbers and connecting bars extending to the rear of the wall equipped with deadman paddles stabilize the wall. Splicer pieces are received in each set of abutting ends of the timbers and are connected to the respective timbers.

10 Claims, 5 Drawing Sheets

PLASTIC RETAINING WALL CONSTRUCTION

BACKGROUND OF THE INVENTION

This invention concerns retaining walls as used in landscaping and grading applications to establish differing soil elevations.

A typical construction for retaining walls is the use of wood timbers or stone or masonry blocks laid up on each other in courses to create a wall. Such construction involves considerable labor due to the weight of the timbers or masonry blocks.

Timbers are also expensive and subject to warpage, splitting, and rot.

The colors available are limited and are not resistant to weathering.

Timbers and masonry blocks must be cut and secured, which adds to the time and labor of building the retaining wall.

Typical methods of anchoring the retaining wall do not always resist soil and water pressure adequately.

The object of the present invention is to provide a wall construction which reduces labor costs in the erection of the wall, is stable, and resistant to changes in appearance due to weathering and the pressures exerted by soil and water.

SUMMARY OF THE INVENTION

The above object is accomplished by a wall construction using lightweight, hollow timbers of various lengths molded from a weather resistant plastic such as PVC, which timbers have snap-fitted lengthwise features which connect the contiguous top and bottom inner edges of the timbers to each other along their full length. The abutting ends of the timbers, which may be angled for right or left hand corners, are connected together by splicer pieces inserted into the hollow ends and pinned to each timber. End caps are also provided to close off ends of the timbers.

Starter strips are initially laid on the graded course for the wall, temporarily held in the proper position with spikes.

A starter timber course is snap-fitted to upstanding rib pairs upwardly projecting from the starter strips at regular intervals.

A series of vertical whaler posts are provided along the inside of the wall to anchor the same, braced by an angled connector bar pinned to the whaler post and which also is connected to a lower, horizontal connector bar pinned to the bottom of the whaler post.

A series of "deadman" paddles are fixed to both connecting bars which resist shifting movement when the wall is backfilled and the spaces between the paddles are packed with soil.

The timbers are held to the whaler posts with U-clips straddling the posts and having flanged ends inserted in mating slots on the inside of the timbers.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
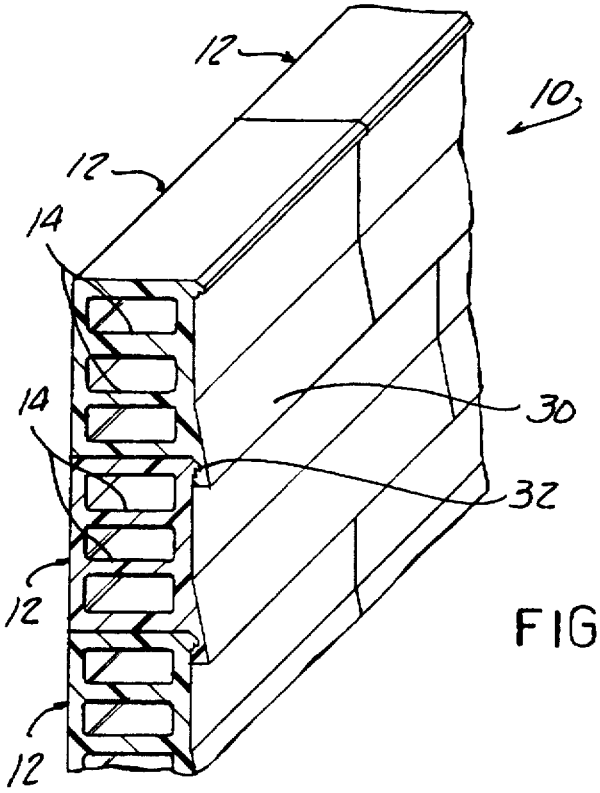
FIG. 1 is a fragmentary perspective view of a built-up wall formed by interfit hollow plastic timbers.

Referring to the drawings and particularly FIG. 1, the retaining wall 10 according to the present invention is built up of individual molded plastic elongated timbers 12 laid atop each other in courses. Each timber 12 generally rectangular in cross section and is molded from a weather resistant rigid plastic such as PVC. Each timber 12 is made hollow by the presence of lengthwise extending cavities, but may be provided with internal stiffening ribs 14 extending horizontally between the inner face and outer face thereof.

The timbers 12 end abut each other in the courses as shown in FIG. 1. A splicing piece 18 is received in the open upper internal hollow spaces of the adjacent end abutting timbers 12 in each course, retained as by plastic push pins 16 received in aligned holes 20 and 22 in the respective top walls of the molded plastic timbers 12 and the splicer pieces 18.

The open ends of exposed timber ends are sealed off by means of end caps 24 received into the open internal hollow spaces with retaining push pins (or pop rivets) 26 securing the end caps in place. Each of the molded timbers 12 are provided on the rear lower edge with a downwardly projecting, outwardly sloping feature 30 which extends along the entire length of the lower edge. This feature is designed to mate with a corresponding mating feature 32 formed on the top edge of the next below timber in the next below course. The front surfaces of the timbers are unencumbered as they do not have such features, to present a smooth exterior appearance as shown.

This mating provides an overlapping captured connection which secures the timbers 12 together preventing upward or outward movement of an overlying timber 12 from the next below timber course and also provides a sealed joint such as to prevent water and silt from washing from behind the retaining wall 10 through gaps between overlying timbers.

A bottom course timber 12A is adapted to be fit to a starter strip 34 which is laid atop the graded site on which the retaining wall 10 is to be erected.

Figure 2:
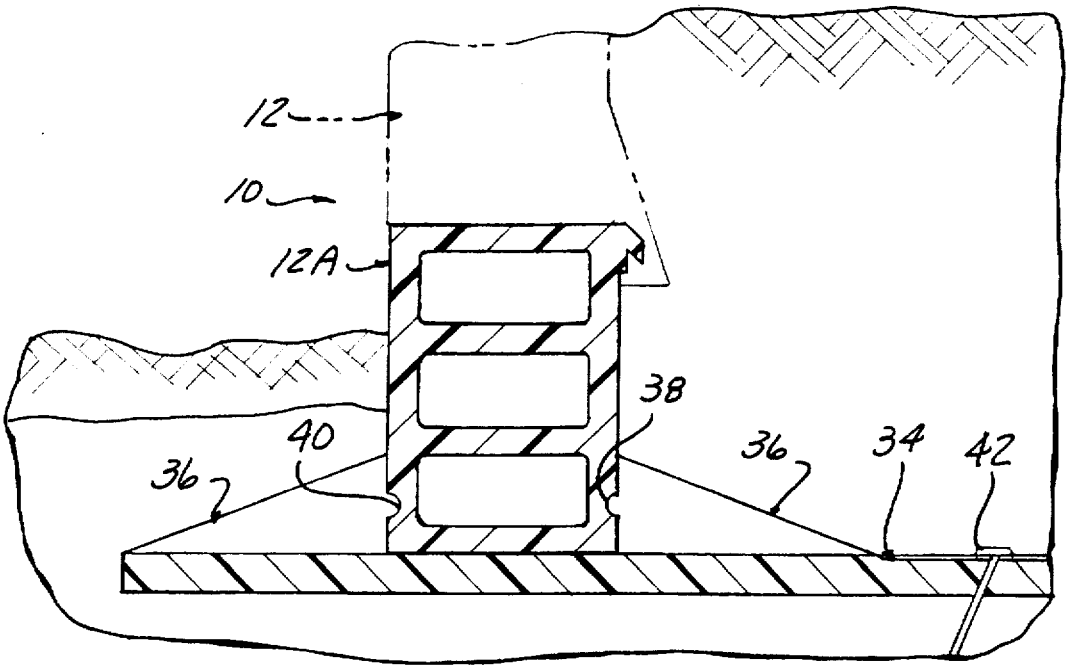
FIG. 2 is a sectional view through a starter strip and first course timber.
Figure 6:
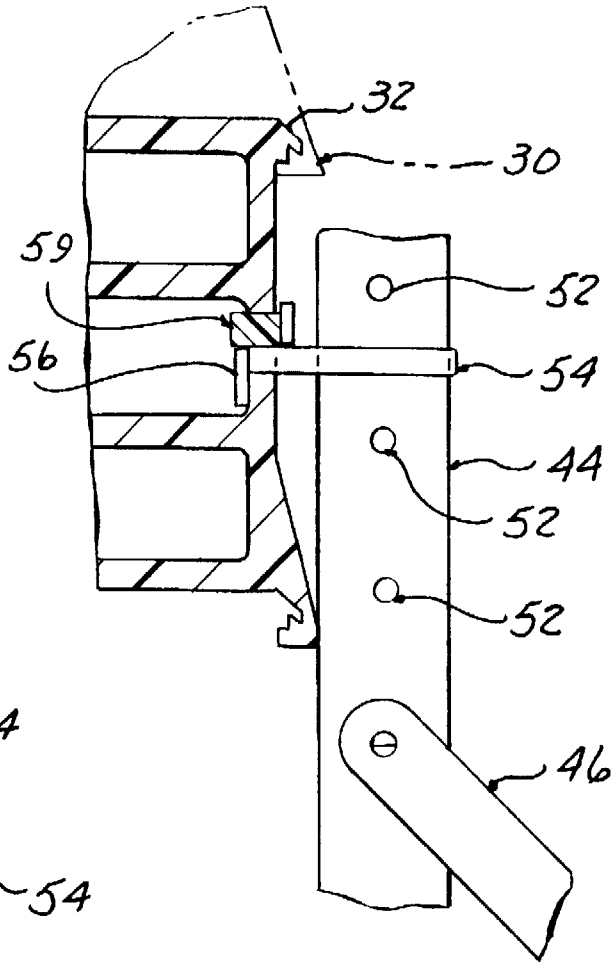
FIG. 6 is a transverse sectional view of a whaler post, a fragmentary portion of a timber, and a U-shaped clip used to join the timber to the whaler post.
Figure 3:
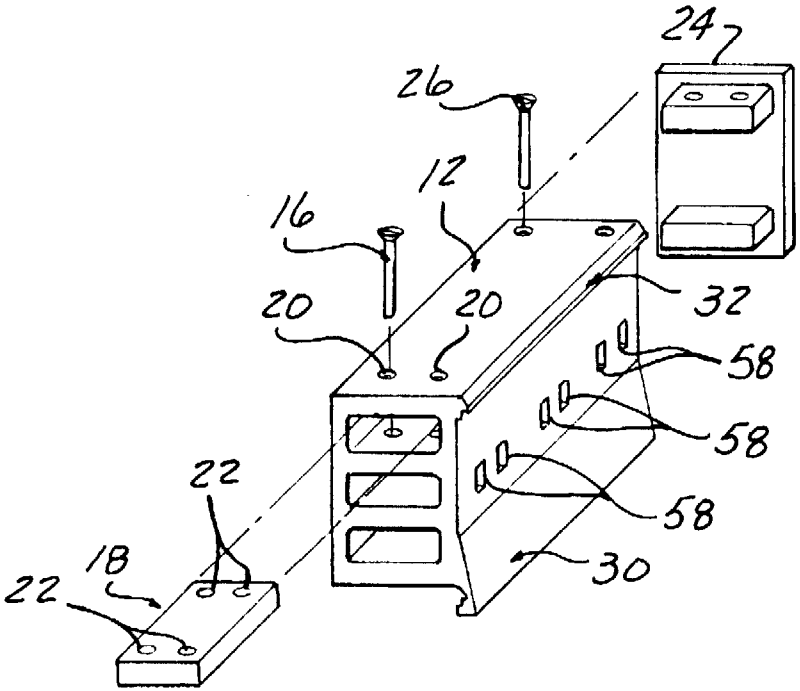
FIG. 3 is an exploded perspective view of a hollow timber and mating splicer piece, end cap, and locking pins.
Figure 7:
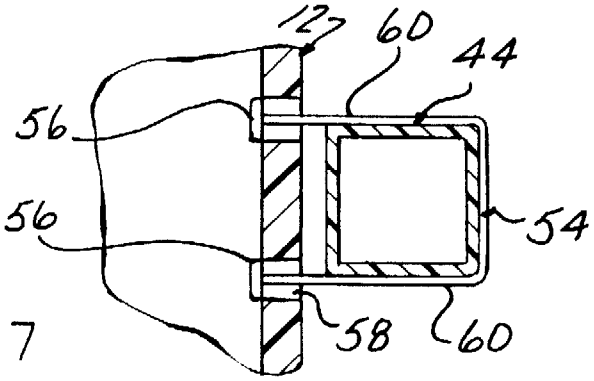
FIG. 7 is a diagrammatic plan view of a retaining wall according to the invention, with whaler posts and connecting bars.

The starter strip 34 is used to line up the wall along a predetermined site line, and is provided with a series of opposing upstanding ribs 36 which have protrusions 38 adapted to be snap fitted in pockets 40 on the bottom course timbers 12A. Perforations for locating stakes 42 may be provided in order to hold the starter strip sections 34 in the correct location. The lower portion of the retaining wall 10 is backfilled in the front as indicated to cover the ribs 36 in the bottom course timber 12A as shown in FIG. 2.

Figure 4:
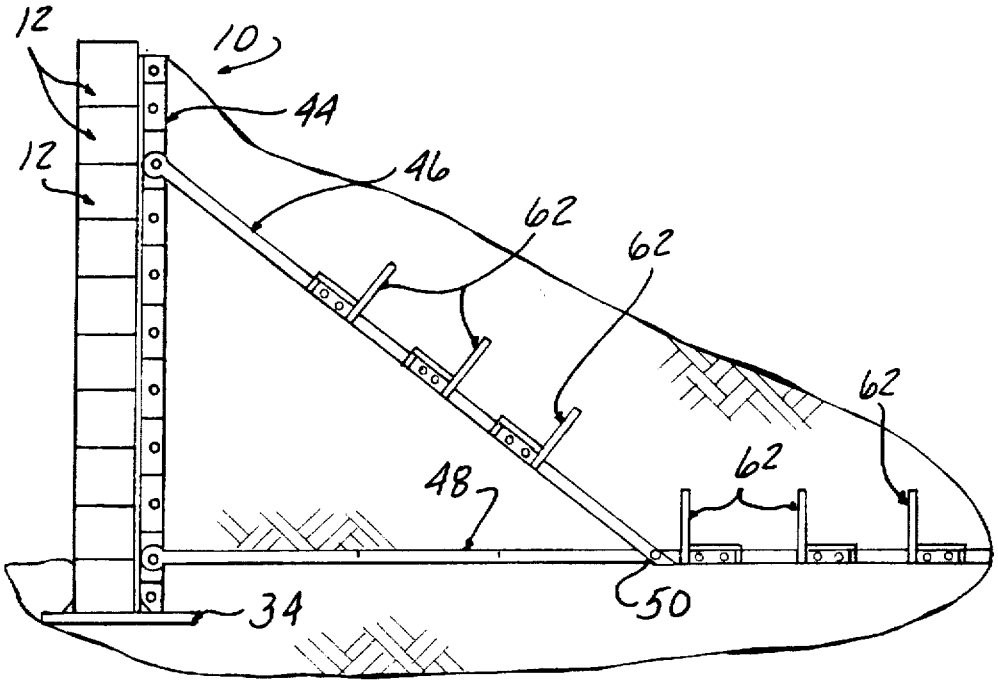
FIG. 4 is a side elevational view of a wall section showing anchoring whaler post and angled and bottom connecting bars.
Figure 5:
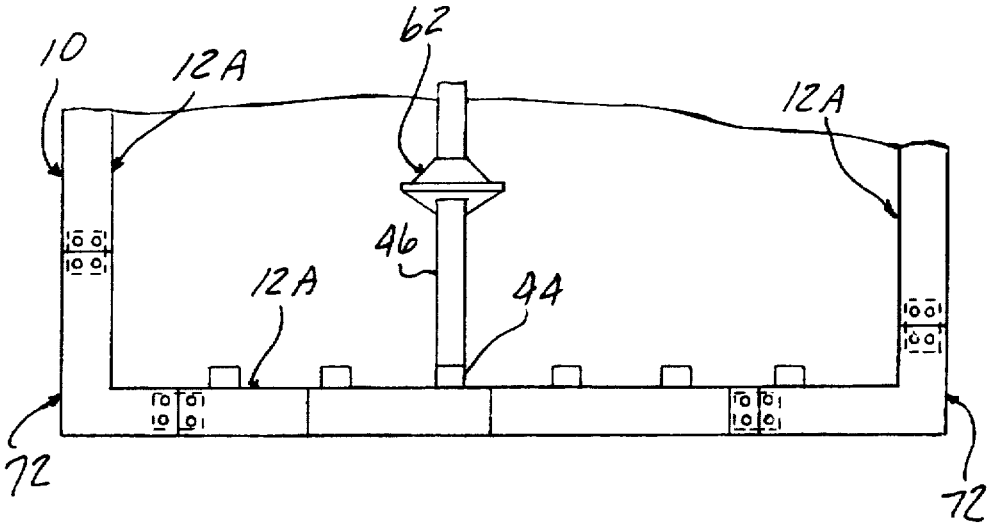
FIG. 5 is a fragmentary sectional view of a timber and adjacent portions of a whaler post and angled connecting bar.

Referring to FIGS. 4 and 5, the retaining wall 10 is stabilized in position by means of a series of whaler posts 44 and angled connecting bars 46 and lower connecting bars 48 pinned to the whaler posts 44 respectively at upper and lower levels as shown in FIG. 4. The other end of the upper connecting bar is pinned at 50 to the lower connecting bar at a point of intersection. The whaler posts 44 are provided with perforations 52 at regular spaced intervals in order to locate the upper connecting bar 46 at the appropriate level depending on the height of the retaining wall.

The individual timbers 12 are also anchored to the whaler posts 44 by means of U-clips 54 which are received around the rectangular whaler posts 44 and have anchoring flanges 56 which are inserted into slots 58 which are formed in spaced apart pairs along the length of each timber 12 and 12A.

The spacing equals the spacing between the opposite legs 60 of the retainer clips 54.

The height of the slots 58 is such as to allow insertion of the flange ends 56 into the slots 58 with the flange ends hooking against the lower edge of the slots 58 to secure the same to the whaler post 44. Square plugs 59 can thereafter be inserted to insure that the flange ends 56 do not become disengaged.

Also provided are deadman paddles 62 attached to both the angled connecting bar 46 and the lower horizontal connecting bar 48 which when having soil packed behind them around resist any lateral shifting movement of the connecting bars 46, 48 and hence of the retaining wall itself.

Figure 8:
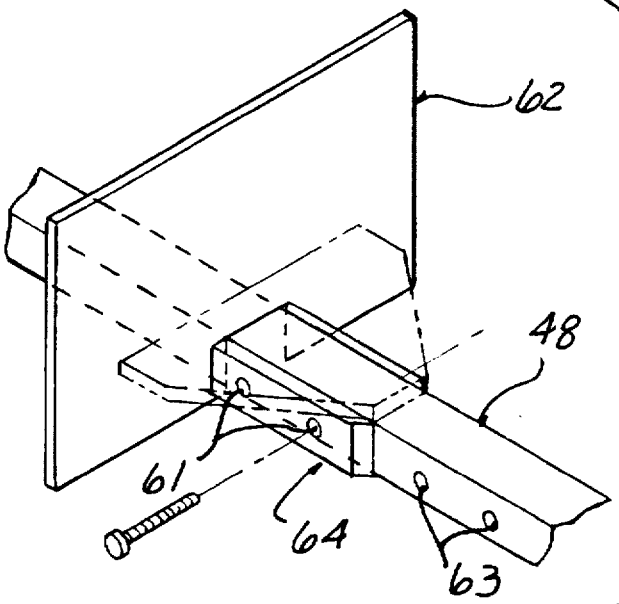
FIG. 8 is a perspective view of a connecting bar and deadman paddles.

The paddles 62, as shown in FIG. 8, each have U-shaped brackets 64 which are sized to slide onto bars 46 or 48 as shown. Holes 61 in the bracket 64 can be aligned with holes 63 along the bars 46 or 48 and push pins 65 inserted.

Thus, this locks the connecting paddles 62 securely thereto such that the resistance created by the soil back filling is transmitted into the connecting bars 46 and 48.

Figure 9:
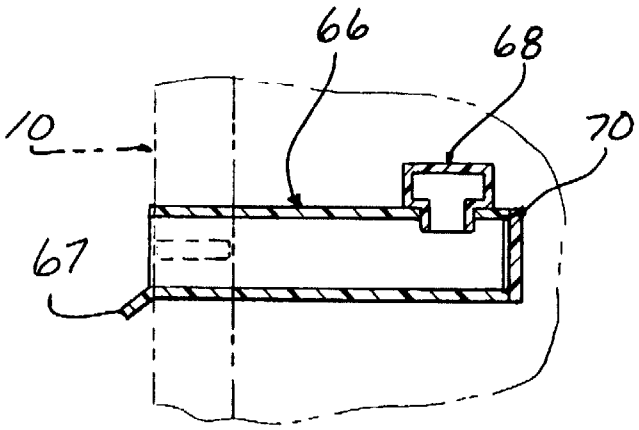
FIG. 9 is a side elevational view of a drain spout fitting for connection to a drain pipe line run behind the retaining wall.
Figure 10:
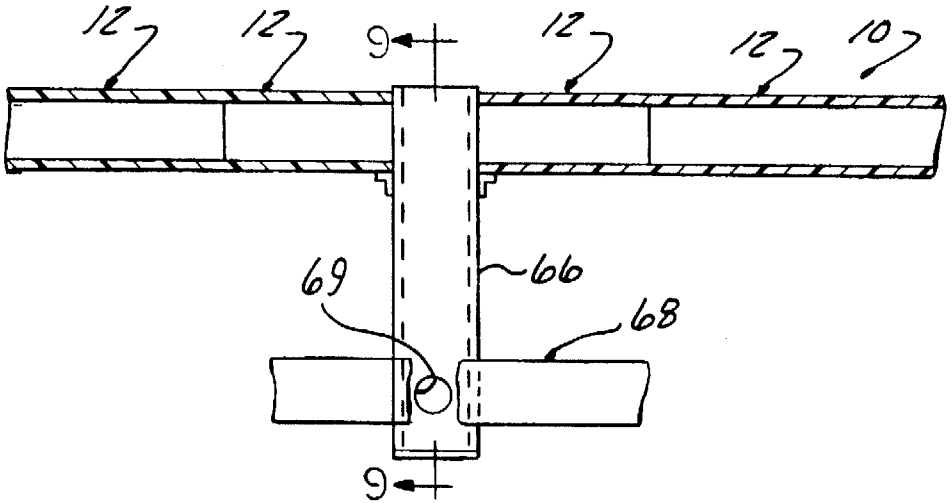
FIG. 10 is a plan view of the drain pipe fitting and adjacent wall sections.

FIGS. 9 and 10 show a drain pipe installation adapted for use with the retaining wall 10 comprising a drain pipe fitting 66 inserted into gaps between timbers 12 with a lower lip 67 allowing draining water to be directed away from the outer face of the retaining wall 10.

The fitting 66 has an opening 69 adapted to receive a perforated pipe 68 extending along the rear of the retaining wall and having a nipple 70 fit into the hole 68 such that water collected in the perforated drain pipe 68 is drained through a series of drain pipes 66.

Figure 11:
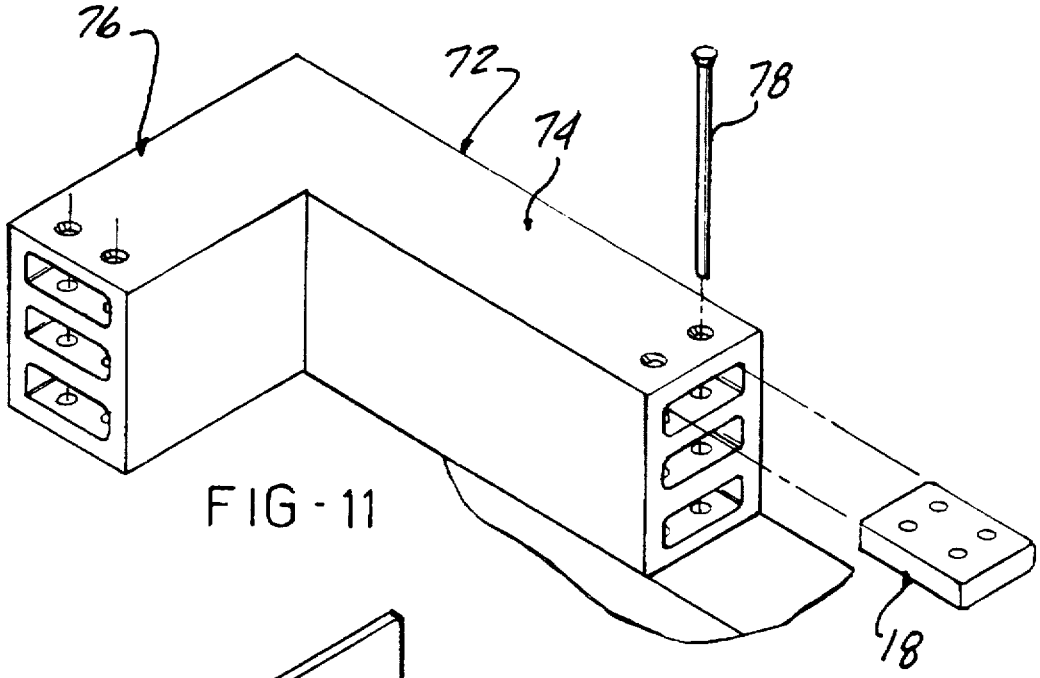
FIG. 11 is a perspective view of a reversible corner timber used in the retaining wall, with exploded perspective view of a splicer piece and push pin components.

FIG. 11 shows a reversible corner timber 72 having unequal length sections 74, 76 extending at right angles to each other. The corner timbers 72 do not snap fit to each other, but rather long length push pins 78 extend all the way through the splicer piece 18 to the next course below and enter holes drilled in that timber to lock the corner timber thereto. The corner timbers 72 are alternately flipped to reverse orientations to avoid aligned seams (see FIG. 5).

The described wall construction can be used for precut planter systems in various shapes, i.e., square, rectangular, octagon, etc.

Basement walls may also be built up using this construction provided suitable sealant is used at the joints, slots, holes, etc.

The cores can be filled to improve insulation characteristics and to stiffen against compression loading for basement applications.

Accordingly, the retaining wall can be erected with minimal labor due to the relatively lightweight components which are quickly secured together by simple assembly steps, while at the same time the retaining wall is secure and stable against the shifting forces exerted by the soil, water, and weather freeze/thaw conditions.

The plastic components resist rot, splitting, warpage, etc. such that the retaining wall should have a long life compared to previous constructions.

The molded plastic can easily be grained to resemble wood and colored with considerable UV resistance against fading.

Accordingly, the above object is accomplished by the disclosed wall construction.

I claim:

1. A retaining wall construction comprising:

a series of elongated, hollow molded plastic timbers generally rectangular in cross section, laid in courses with a flat bottom of each course resting atop a flat top of the timbers in the next below course to form a wall;

said timbers each having a depending skirt portion extending along a lower rear edge and extending downwardly substantially below a top edge of a next below to cover the same and prevent water seepage between said timbers, each of said timbers also having lengthwise feature extending entirely along said top edge and engaged by a mating integrally molded feature of said skirt portion to capture each other and interlock said timbers together against upward or frontward movement of an overlying timber on a lower timber course:

each of said timbers having unencumbered front surfaces to present a smooth appearance.

2. The retaining wall construction according to claim 1 further including splicer pieces received in open abutting ends of adjacent timbers and fastened to both adjacent timber ends.

3. The retaining wall construction according to claim 1 further including a series of vertical posts mounted on the inside of said retaining wall and secured thereto.

4. The retaining wall construction according to claim 3 further including elongated connector bars attached to at least one of said posts and extending rearwardly behind said wall.

5. The retaining wall construction according to claim 4 further including a series of paddles comprising flat plates attached to said connector bars extending transversely thereto adapted to resist movement when packed with soil behind said retainer wall.

6. The retaining wall construction according to claim 4 wherein one connector bar is attached at an upper portion of said post and angled down, another connector bar is attached to a lower portion of said post and extending directly rearwardly, said connector bars fixed to each other at a point of intersection.

7. The retaining wall construction according to claim 3 wherein a series of U-shaped clips are fit to said post and have ends hooked to a timber through slots molded into a rear wall of said timbers.

8. The retaining wall construction according to claim 1 wherein said timbers are molded with an internal bracing web extending between forward and rear walls thereof.

9. The retaining wall construction according to claim 1 further including a drain pipe having an end inserted between the ends of adjacent timbers and an opposite end connected to a perforated drain pipe.

10. The retaining wall construction according to claim 1 wherein said hollow timbers are molded of PVC plastic.

* * * * *